US006880999B2

(12) United States Patent
Biegel et al.

(10) Patent No.: US 6,880,999 B2
(45) Date of Patent: Apr. 19, 2005

(54) APPLICATOR DEVICE

(75) Inventors: Friedrich Biegel, Nuremberg (DE); Rene Heinlein, Nuremberg (DE); Georg Roeder, Schwabach (DE)

(73) Assignee: Schwan-Stabilo Cosmetics GmbH & Co. KG, Heroldsberg (DE)

( * ) Notice: Subject to any disclaimer, the term of this patent is extended or adjusted under 35 U.S.C. 154(b) by 0 days.

(21) Appl. No.: 10/453,981

(22) Filed: Jun. 4, 2003

(65) Prior Publication Data

US 2004/0151530 A1 Aug. 5, 2004

(30) Foreign Application Priority Data

Feb. 4, 2003 (EP) ..... 03002416

(51) Int. Cl.[7] ..... B43K 1/10
(52) U.S. Cl. ..... 401/180; 401/66; 401/61; 401/174
(58) Field of Search ..... 401/61, 66, 159, 401/174, 179, 180, 182

(56) References Cited

U.S. PATENT DOCUMENTS

| | | | | |
|---|---|---|---|---|
| 2,258,841 A | * | 10/1941 | Biro | 401/194 |
| 2,432,061 A | | 12/1947 | Chesler | 120/49 |
| 4,991,989 A | | 2/1991 | Fitjer | 401/155 |
| 5,242,234 A | | 9/1993 | Ahrens | 401/180 |
| 5,423,623 A | | 6/1995 | Bakic | 401/70 |
| 6,200,055 B1 | * | 3/2001 | Fusaro, Jr. | 401/178 |

FOREIGN PATENT DOCUMENTS

| | | |
|---|---|---|
| DE | 42 00 964 C1 | 8/1993 |
| GB | 597143 | 1/1948 |

* cited by examiner

*Primary Examiner*—Gregory L. Huson
*Assistant Examiner*—Peter deVore
(74) *Attorney, Agent, or Firm*—Bachman & LaPointe, P.C.

(57) ABSTRACT

The invention concerns an applicator device comprising a storage means for storing a product to be applied, and an increased pressure-producing device having an elastic device, wherein the elastic device is designed to press with its elastic return force against a boundary means of the storage means, to produce an increased pressure in the storage means.

Figure 1:
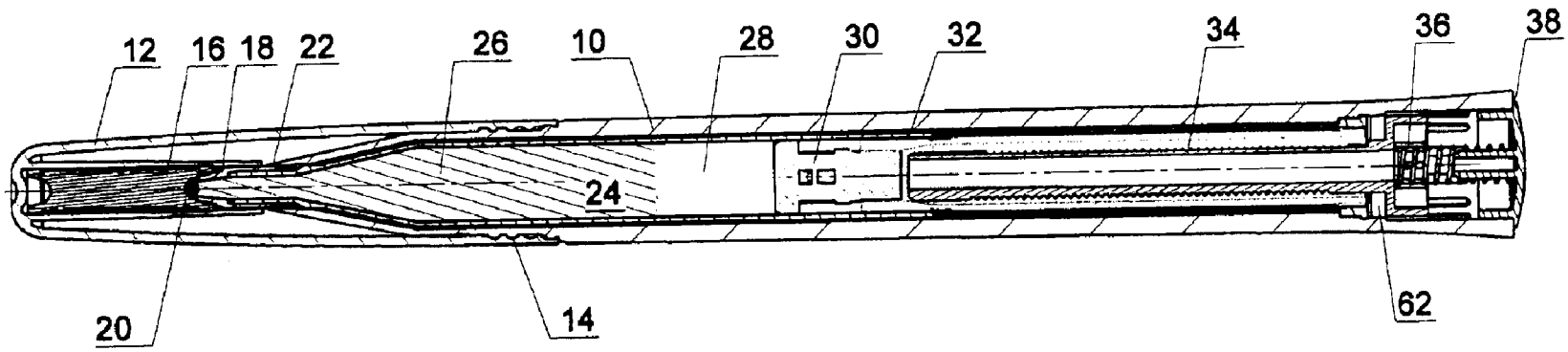

In accordance with the present invention it is provided that the increased pressure-producing device is controllable to provide a reduction in the pressure in the storage means.

24 Claims, 4 Drawing Sheets

APPLICATOR DEVICE

The invention concerns an applicator device having a storage means for the storage of a product to be applied and an increased pressure-producing device having an elastic device, wherein the elastic device is adapted to press with its elastic return force against a boundary means of the storage means to produce an increased pressure in the storage means.

An applicator device of the above-indicated kind is known, for example from DE 42 00 964 C1. In that respect the term applicator device is not used for example to denote only a writing or drawing pen. Rather, the invention can be applied to all kinds of applicator devices, whether for drawing, painting, writing, marking or the like or whether for applying cosmetics to skin or hair. Relevant examples are make up pencils for applying make up to lips, eyebrows, eyelids, cheeks, fingernails, toenails and so forth. Accordingly the invention also relates to all kinds of 'products to be applied', that is to say for example to writing, drawing, painting and marking inks and also to cosmetic products which can be applied with applicator devices, in particular in the form of pencils or pens or crayons. The products to be applied can be of any consistency which is applicable by an applicator device. Examples are liquid, gel-like and pasty products.

The pen in accordance with DE 42 00 964 C1 is of such a structure that pressure forces which always remain constant are applied to the storage means. In other words, a constant increased pressure always obtains in the storage means of the known pen. Such an on-going increased pressure can have a damaging effect on the product which is to be applied. In the event of a leak occurring the permanent increased pressure will result in the product immediately escaping.

The object of the invention is to improve the applicator device of the kind set forth in the opening part of this specification, in such a way as to better obviate damage to the product to be applied and/or escape thereof.

In accordance with the invention the specified object is attained in that the increased pressure-producing device is controllable to produce a reduction in the pressure in the storage means.

In that respect the invention is based on the realisation that the increased pressure in the storage means is not required at all times, but only when the applicator device is in use. Controllability of the increased pressure-producing device to provide a reduction in the pressure in the storage means affords in that respect the possibility of reducing the pressure when it is not required, thereby minimising a possibly damaging influence of the increased pressure on the product to be applied. In addition it is possible in this way to more effectively preclude the product from possibly escaping in the event of leaks developing.

DE 23 31 285 C2, DE 40 27 271 C1 and DE-OS No 23 09 738 each disclose pens in which an increased pressure-producing device does not make use of an elastic device, but in which, rather, operation is implemented with a gas pressure. In that way the structure is complicated and expensive and thus cost-intensive, in particular having regard to sealing problems. In comparison in accordance with the invention there is used an elastic device in the context of the increased pressure-producing device, thereby eliminating in particular sealing problems. In addition it is possible to achieve a particularly simple structure whereby handling is improved and also manufacturing costs can be kept down.

The elastic device in principle can be of any desired configuration. However a spring is preferred as being particularly simple.

Preferably the increased pressure-producing device has a transmission arrangement with two coupling elements which are adapted to come into engagement with each other in at least two different relative positions. Those two different relative positions can serve to take account of different operating states.

Thus the two relative positions can be associated with different filling levels of the storage means. In other words, this embodiment of the invention provides that, at a first filling level of the storage means, the two coupling elements of the transmission arrangement are in a first relative position with respect to each other, in which for example the elastic device produces a predetermined increased pressure in the storage means. If now the filling level in the storage means falls due to use of the pen, the two coupling elements assume a different relative position with respect to each other, with which the same increased pressure is produced in the storage means.

While otherwise the increased pressure produced in the storage means would fall with a falling filling level in the storage means and with a concomitant relief of stress in respect of the elastic element, it is possible in that way to provide that the same increased pressure is always produced in the storage means, irrespective of the filling level.

In accordance with a particularly preferred embodiment of the invention the increased pressure-producing device has a transmission arrangement comprising at least one female screwthread and at least one male screwthread element, wherein the transmission arrangement can assume at least two operating states, namely a first operating state in which the two screwthread elements mesh with each other to produce the increased pressure and a second operating state in which they do not mesh with each other, that therefore resulting in a reduction in the pressure.

In other words, this preferred embodiment of the invention provides that two screwthread elements are coupled together to produce the increased pressure and are uncoupled to reduce the pressure in the storage means. That therefore affords a configuration which is particularly simple in terms of structure, inexpensive and easy to handle.

In that respect, in accordance with the invention, it is possible to use a screwthreaded rod with at least one screwthread interruption, for example in the form of a longitudinal groove. With that structure, for uncoupling purposes, it is only necessary for the female screwthread element to be moved into the screwthread interruption.

Particularly to ensure that the product to be applied is further protected and treated gently, in accordance with the invention there is provided a device for limiting the increased pressure produced by the increased pressure-producing device. Furthermore that feature evidently also contributes to leakage resistance.

In accordance with the invention, as a structurally particularly simple configuration, it is provided that the limiting device has an abutment.

The abutment is further preferably provided on a male screwthread element.

In accordance with a particularly preferred embodiment of the invention the abutment is disposed in a path along which a female screwthread element moves when the two screwthread elements mesh with each other.

Once again this has provided a configuration which is structurally particularly simple and also simple to handle.

The limiting device further preferably has a slipping coupling. That affords a substantial safeguard against the consequences of inappropriate handling because the slipping coupling automatically disengages in the event of an attempt to produce an excessively high increased pressure.

In accordance with a further embodiment of the invention it is provided that the increased pressure-producing device has a transmission arrangement with a toothed rack and a latch, wherein the toothed rack and the latch are preferably adapted to come into engagement with each other and out of engagement with each other in at least two different relative positions.

That configuration represents an alternative to the above-described configuration with the rotary transmission arrangement.

In accordance with the invention the increased pressure-producing device preferably has a piston which does not necessarily have to be of a round external contour. That piston can represent for example that boundary means of the storage means, against which the elastic return force of the elastic device for producing the increased pressure in the storage means presses.

In accordance with the invention there is further preferably provided a device which prevents the piston from drawing the product back into the storage means upon a drop in the increased pressure.

In that case the piston can be in the form of a drag piston.

In this connection it is particularly preferred in accordance with the invention that the piston is coupled to the elastic device with play and/or by way of an elastic element.

In order to prevent the product which is to be applied from running out and drying out the invention in accordance with a particularly preferred embodiment provides a closure material for sealing off the product in the storage means. The storage means, the piston and/or a writing tip of the pen preferably in accordance with the invention have LCP (liquid crystal polymers). That material is highly advantageous in particular at locations of the pen which come into contact with the product to be applied, because it is extremely diffusion-dense. In addition it is distinguished by a high degree of accuracy to size, which is important in particular in relation to parts which are disposed movably relative to each other, such as for example the piston which is movable in the storage means. More specifically the high level of accuracy to size prevents jamming. Finally LCP is distinguished by a high level of chemical resistance so that it cannot be attacked by the product which is to be applied.

Preferably the applicator device has a shock absorber at its rear end. That ensures that, in the event of a possible impact on the applicator device with its rear end the product to be applied is not urged away from the writing tip into the storage means.

The shock absorber preferably comprises a spring.

In accordance with a particularly preferred embodiment the spring of the shock absorber serves to produce the increased pressure. In other words, attributed to the elastic element which serves to produce the increased pressure is a second function, namely that of the shock absorber, whereby the number of parts overall is reduced.

It can happen that a user of the applicator device forgets to reduce the pressure in the storage means after it has been used. In such a situation under some circumstances the product which is to be stored suffers damage, in the storage means. In addition it is possible that the product will escape from the device.

Therefore the invention provides an applicator device, in particular of the kind referred to in greater detail hereinbefore, comprising a storage means for the storage of a product to be applied and an increased pressure-producing device for producing an increased pressure in the storage means, wherein the applicator device can assume at least two operating states, namely a rest state and a state of use. In that respect in accordance with the invention there is provided a device for reducing the pressure in the storage means, said device responding to the applicator device being changed from the state of use into the rest state.

In other words, this embodiment of the invention provides that the pressure in the storage means is automatically reduced as soon as the applicator device—after use thereof—is put into the rest state.

The rest state and the operational state can be distinguished from each other in particular by virtue of the fact that in the rest state a cap (protective cover) is fitted on to the applicator device whereas in the operational state the cap is removed.

Therefore in accordance with a particularly preferred embodiment the invention provides a coupling between a cap and the increased pressure-producing device. In other words, this embodiment of the invention provides that removal of the cap entails the production of an increased pressure in the storage means, whereas fitting the cap on to the applicator device results in an automatic reduction in the pressure in the storage means.

In that respect, a particularly advantageous configuration provides that a screwthread is preferred for holding the cap on the applicator device. Instead of the screwthread, it is also possible to provide a bayonet fixing for holding the cap on the applicator device. Such a bayonet fixing has in particular the advantage that that angle of rotary movement through which the cap is turned with respect to the applicator device is limited so that there is no need of any further special measures to limit the increased pressure produced in the storage means by virtue of the cap being fitted on to the applicator device. Under some circumstances accordingly that configuration can manage without the slipping coupling and without the above-mentioned increased pressure-limitation.

Particularly in the region of reductions in diameter in the path of the product which is to be applied, in going from the storage means to a writing tip of the applicator device, air inclusions frequently occur, which are disadvantageous in terms of operation of the applicator device.

Therefore a further object of the present invention is to avoid such air inclusions.

Finally therefore the invention provides an applicator device, in particular of the type referred to in detail hereinbefore, comprising a storage means having a front end region for the storage of a product to be applied and a writing tip, wherein a rear end region of the writing tip is sleeve-shaped and the front end region of the storage means is fitted into the rear end region of the writing tip.

If more specifically—as is the case in the state of the art—the rear end region of the writing tip is fitted into the front end region of the storage means, that affords a reduction in diameter in the region of the end face of the writing tip, which is towards the storage means. If however in contrast in accordance with the invention the front end region of the storage means is fitted into the rear end region of the sleeve, that does not involve a reduction in diameter in the transitional region, thereby reliably avoiding the above-mentioned air inclusions.

Figure 2:
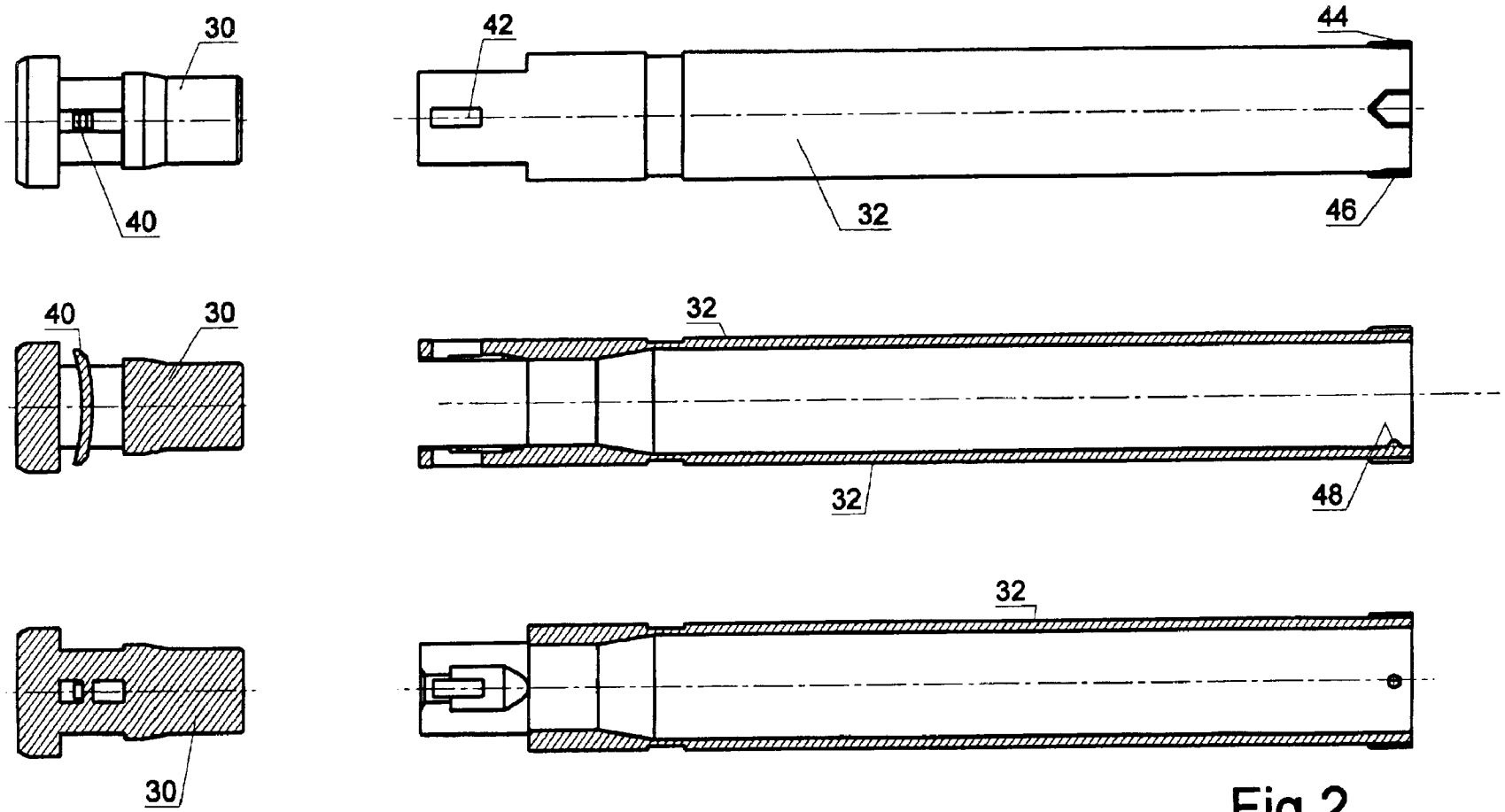
Figure 3:
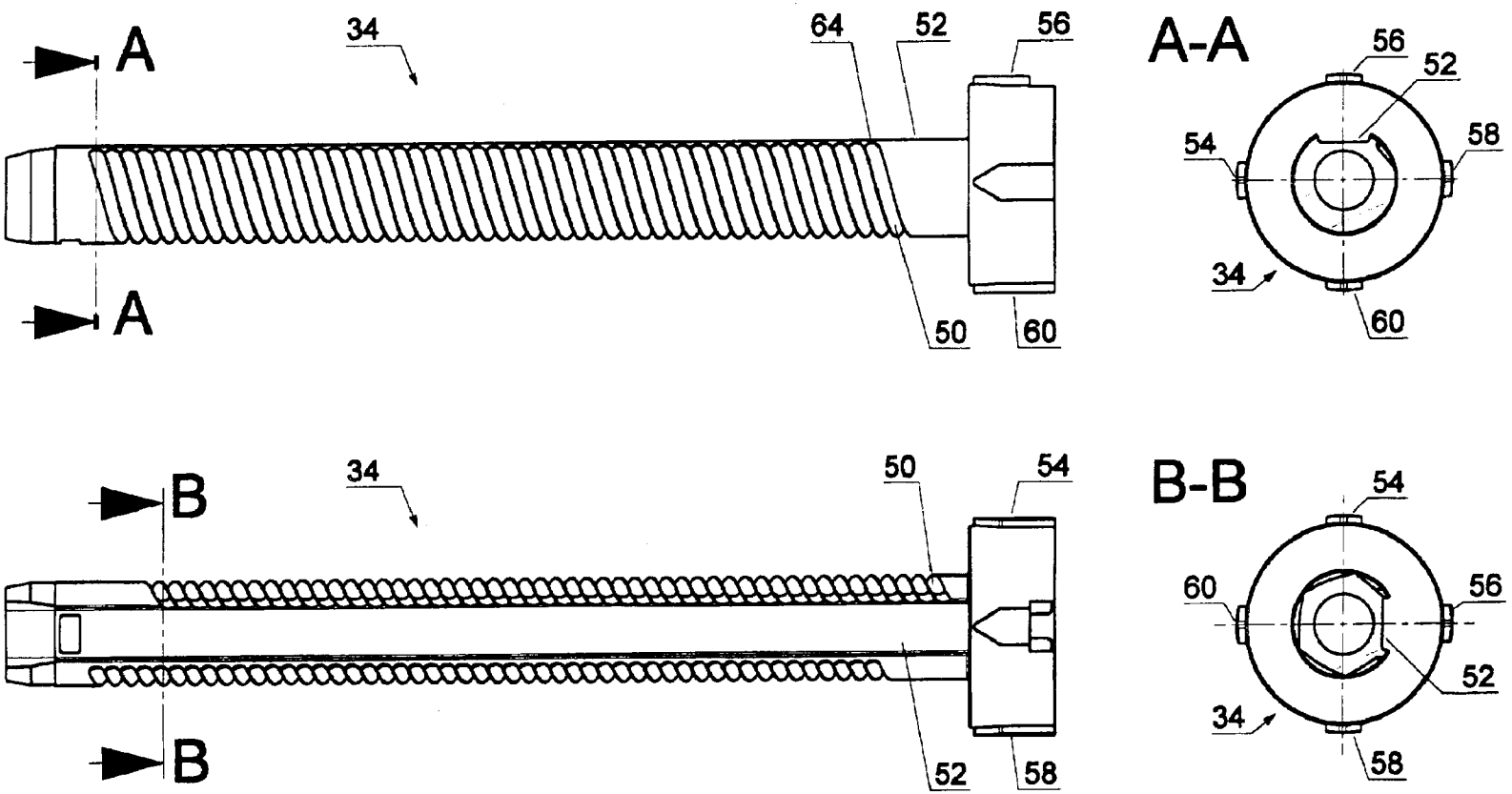
Figure 4:
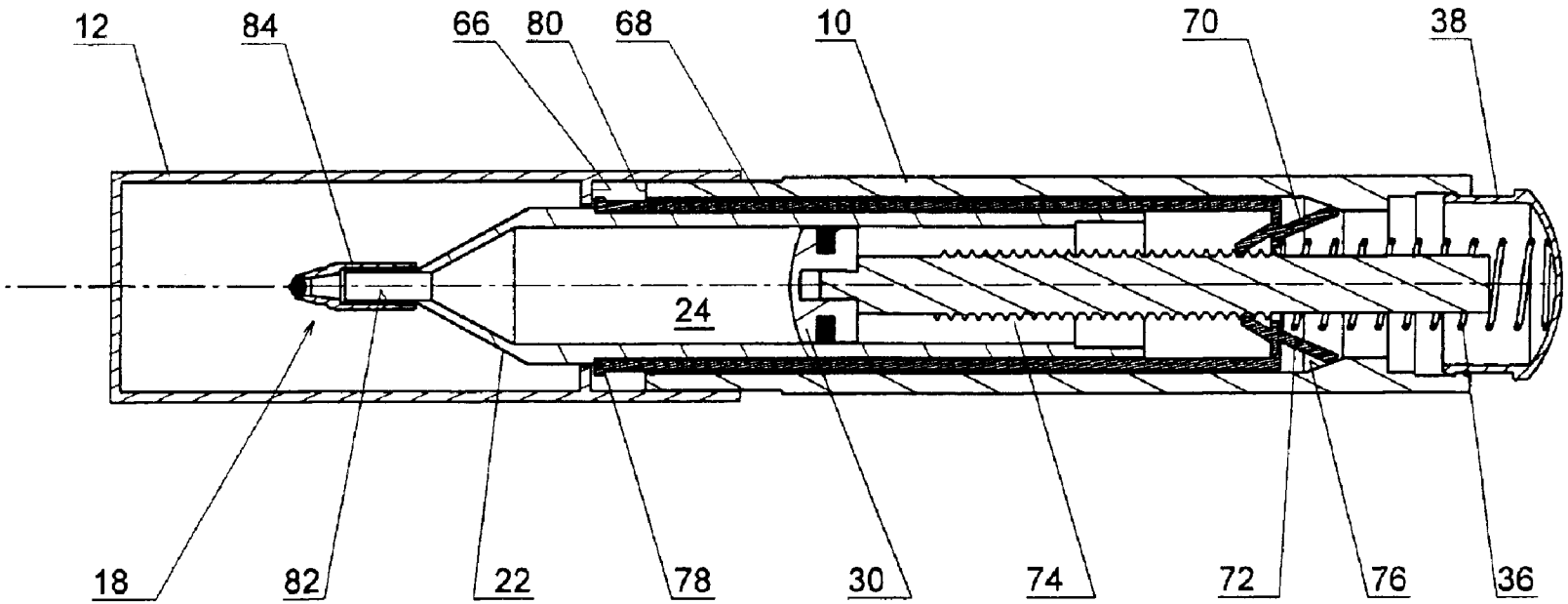

The invention is described in greater detail hereinafter by means of two preferred embodiments in the form of pens with reference to the accompanying drawing in which:

FIG. 1 shows a view in longitudinal section of a pen in accordance with a particularly preferred embodiment of the invention, FIG. 2 shows views of a piston arrangement of the pen shown in FIG. 1, FIG. 3 shows views of a control pushrod as shown in FIG. 1, and FIG. 4 shows a diagrammatic view in longitudinal section of a further embodiment of the invention.

Referring to FIG. 1 the pen has an outer stock or casing 10 on to which a cap 12 is screwed in the operative position shown in FIG. 1. A screwthread identified by reference numeral 14 is provided for that purpose. The cap 12 has a seal 16 which, in the operative state shown in FIG. 1, sealingly encloses a tip 18. A ball 20 is held at the free end of the tip 18. The internal contour of the seal 16 differs from a circular shape and is oval. The external contour of the tip 18 is of a complementary external contour in that region in which it is enclosed by the seal 16. In that way the cap 12 is rotationally coupled to the tip 18 in the condition of being fitted on to the casing.

At its end portion remote from the ball 20 the tip 18 is enclosed by a cartridge sleeve 22. In that region the tip 18 is of a circular external contour. With the cartridge sleeve 22 the tip 18 forms a slipping coupling.

The internal space of the cartridge sleeve 22 forms a storage means 24 for ink 26. Arranged in the storage means 24, on the side remote from the ball 20, is a closure material 28 which serves to seal it off in relation to the ambient atmosphere. The rearward boundary of the storage means 24 is formed by a piston 30. The piston 30 is disposed slidably within the storage means 24. As viewed from the ball 20, a piston holder 32 is disposed behind the piston 30. A control pushrod 34 projects into the piston holder. A spring 36 is supported on the one hand against the control pushrod 34 and on the other hand against a closure cap 38.

As can be seen from FIG. 2 the piston 30 has a projection 40 which in the assembled condition engages into a window 42 in the piston holder 32. The piston holder 32, at its end portion remote from the piston 30, has projections 44 and 46 which engage into corresponding openings in the cartridge body 22 to provide for rotational coupling. Accordingly the piston holder 32 is admittedly rotationally coupled to the cartridge body 22 but is held axially slidably therein.

Also at its end portion remote from the piston 30, the piston holder 32 is provided in its interior with a substantially hemispherical female screwthread element 48 which serves for coupling it from time to time to the control pushrod 34.

The control pushrod 34 is provided with male screwthread elements which are complementary to the female screwthread element 48 and of which one is identified by way of example by reference numeral 50. The male screwthread elements 50 correspond to segments of a helical groove and each extend over an angle of somewhat more than 300°. They are interrupted by a longitudinal groove 52 which extends over an angle of about 27°.

At its end portion remote from the ball 20 the control pushrod 34 is provided with projections or lugs 54, 56, 58, 60 which engage into corresponding openings of the outer casing 10 for rotational coupling purposes. The control pushrod 34 is however axially displaceable with respect to the outer casing 10 between the closure cap 38 and an abutment 62.

The mode of operation of the pen illustrated in the drawing is as follows:

In the operative position shown in FIG. 1, that is to say when the cap 12 is screwed on to the outer casing 10, the female screwthread 48 is disposed in the groove 52. Accordingly, in that operative position, there is no coupling effect between the control pushrod 34 and the piston 30. The piston 30 accordingly does not exert any pressure on the closure material 28 or the ink 26.

If the cap 12 is rotated with respect to the outer casing 10 in order to unscrew it, the tip 18 also rotates by virtue of the rotatable coupling between the seal 16 and the tip 18. Accordingly the piston holder 32 also rotates. In the further course of the rotary movement, the female screwthread 48 leaves the groove 52 and passes into the male screwthread element 50. Further rotary movement in that state provides that the female screwthread element 48 moves along the male screwthread element 50 whereby the control pushrod 34 which hitherto was supported at the projection 62 is urged against the spring 36. As a result the elastic return force of the spring 36 acts by way of the control pushrod 34 on the piston holder 32 and thereby on the piston 30, whereby the pressure in the storage means 24 rises. At its end, the male screwthread element 50 is delimited by an abutment 64 against which the female screwthread element 48 butts upon further rotary movement. If nonetheless the rotary movement is continued the slipping coupling provided between the cartridge sleeve 22 and the tip 18 slips so that the pressure in the storage means 24 does not rise any further.

The increased pressure which is now built up in the storage means 24 can be used for discharge of the ink 26.

If, after use of the pen, the cap 12 is screwed back on to the outer casing 10, the female screwthread element 48 moves back along the male screwthread element 50 into the groove 52 again, because of the coupling configurations described in detail hereinbefore. As a result the control pushrod 34 comes into contact again under the influence of the spring 36 against the abutment 62 where it is supported. Accordingly the spring 36 no longer acts on the ink 26 by way of the piston holder 32 and the piston 30. In this condition there is no longer any increased pressure in the storage means 24, and this is of great advantage in regard to treating the ink 26 carefully and in regard to preventing it from escaping.

When the cap 12 is screwed on to the outer casing 10 the piston holder 32 is moved in a direction away from the ball 20 until the female screwthread 48 passes into the groove 52. So that in that case the piston 30 does not suck the ink out of the tip 18, the piston 30 is in the form of a drag piston. More specifically, the piston holder 32 can move away from the ball 20, in a manner corresponding to the axial length of the window 42, without entrainment of the piston 30.

In addition to or instead of the projection 40 in the window 42, it is also possible to provide an elastic coupling between the piston holder 32 and the piston.

The elastic coupling and/or the play can however also be provided elsewhere between the control pushrod 34 and the piston surface which delimits the storage means 24.

Instead of the screwthread 14, it is also possible to provide a bayonet fixing for holding the cap 12 on the outer casing 10. In that case, it is possible under some circumstances to forego the limitation on the increased pressure produced, by virtue of the abutment 64, because when a bayonet fixing is employed that angle through which the two parts which are to be connected to each other can be rotated relative to each other is limited in any case.

The embodiment of FIG. 4 is described hereinafter:

In this embodiment the cap is not screwed on to the outer casing 10 but rather is pushed axially thereon. When it is pushed on an abutment 66 on the cap 12 entrains a control sleeve 68 in the axial direction. The control sleeve 68 is provided with two latches 70, 72 which, in the operative state shown in FIG. 4, are in engagement with a toothed rack 74. The control sleeve 68 therefore together with the latches 70 and 72 and the toothed rack 74 forms a latching arrangement. In the operative state shown in FIG. 4 the spring 36 presses with its elastic return force against the control sleeve 68. By virtue of the engagement of the latches 70 and 72 with the toothed rack 74 the pressure produced by the spring 36 is transmitted to the piston 30 by way of the toothed rack 74, whereby the piston 30 produces an increased pressure in the storage means 24.

If however the cap 12 is pushed on to the outer casing, the control sleeve 68 is displaced axially rearwardly whereby the latches 70 and 72 bear with an end portion against a peripherally extending control cam 76 and, upon further axial displacement, are pivoted out of engagement with the toothed rack 74. As a result of this, the force exerted by the spring 36 is no longer transmitted to the toothed rack 74 and thus also no longer transmitted to the piston 30, whereby the increased pressure in the storage means 24 falls.

As in the case of the embodiment shown in FIGS. 1 to 3, the respective transmission arrangements, that is to say the rotary transmission arrangement shown in FIGS. 1 to 3 and the latching arrangement shown in FIG. 4, can compensate for a reduction in the filling level in the storage means 24. More specifically, with a decreasing filling level, for example the toothed rack 74 shown in FIG. 4 gradually moves into the storage means 24, together with the piston 30. Nonetheless, the same return force of the spring 36 can be used in each case to produce the increased pressure in the storage means 24. The same applies for the piston holder 32 with the piston 30 in FIGS. 1 to 3. Those two elements also move gradually into the storage means 24, with a decreasing filling level in the storage means 24, whereas the control pushrod 34 does not change its position relative to the spring 36 in a manner corresponding to the filling level, and for that reason the same return force is always available to produce the increased pressure.

In the embodiment shown in FIG. 4 an increased pressure limitation effect is afforded by virtue of the fact that the abutment 66 or an annular projection 78 on the control sleeve 68 bears against an abutment 80 on the outer casing 10.

In the embodiment shown in FIG. 4 a front end portion 82 of the cartridge sleeve 22 is inserted into a rear end portion 84 of the writing tip 18. That design configuration avoids a stepped reduction in cross-section in the path of flow of the product 26 from the storage means 24 in the tip 18, thereby eliminating the risk of air inclusions.

In the embodiment shown in FIG. 4, the closure cap 38 is held resiliently in the manner of a shock absorber. The spring 36, that is to say that elastic element whose force serves to produce the increased pressure in the storage means 24, serves to provide that resilient holding effect. As a result, this design configuration provides for minimising the number of component parts.

The features of the invention which are disclosed in the foregoing description, the claims and the drawing can be essential, both individually and also in any combinations, for carrying the invention into effect in the various embodiments thereof.

What is claimed is:

1. An applicator device comprising a storage means for storing a product to be applied, an increased pressure-producing device having an elastic device, wherein the elastic device is designed to press with its elastic return force against a boundary means of the storage means, to produce an increased pressure in the storage means, the increased pressure-producing device is controllable to provide a reduction in the pressure in the storage means and comprises a transmission arrangement comprising a first element and a second element, wherein the transmission arrangement can assume at least two operative states, namely (1) a first operative state in which the elements engage with each other to produce the increased pressure, and (2) a second operative state in which the elements do not mesh with each other, thereby resulting in a fall in the pressure.

2. An applicator device as set forth in claim 1, wherein the first element is a female screwthread element and the second element is a male screwthread element.

3. An applicator device as set forth in claims 1, wherein the elastic device is a spring.

4. An applicator device as set forth in claim 2, wherein the male screwthread element comprises a screwthreaded rod with at least one screwthread interruption.

5. An applicator device as set forth in claim 1, further comprising means for limiting the increased pressure produced by the increased pressure-producing device.

6. An applicator device as set forth in claim 5, wherein the means for limiting includes an abutment.

7. An applicator device as set forth in claim 6, wherein the abutment is provided on the second element.

8. An applicator device as set forth in claim 6, wherein the abutment is disposed in a path along which the first element moves when the two elements engage with each other.

9. An applicator device as set forth in claim 5, wherein the limiting device has a slipping coupling.

10. An applicator device as set forth in claim 1, wherein the increased pressure-increasing device has a piston.

11. An applicator device as set forth in claim 10, further comprising a means for preventing the piston from pulling the product back into the storage means upon a drop in the increased pressure.

12. An applicator device as set forth in claim 10, wherein the piston is a drag piston.

13. An applicator device as set forth in claim 10, wherein the piston is coupled to an elastic device.

14. An applicator device as set forth in claim 1, further comprising a closure means for sealing off the product in the storage means.

15. An applicator device as set forth in claim 10, wherein the storage means, the piston and/or a writing tip of the applicator device has LCP.

16. An applicator device as set forth in claim 3, further comprising a shock absorber at a rear end.

17. An applicator device as set forth in claim 16, wherein the shock absorber has the spring.

18. An applicator device as set forth in claim 17, wherein the spring of the shock absorber serves to produce the increased pressure.

19. An applicator device as set forth in claim 1, comprising activating means for moving the applicator device between at least two operative states, namely a rest state and a state of use, wherein a device for reducing the pressure in the storage means is responsive to the moving means when transferring the pen from the state of use into the rest state.

20. An applicator device as set forth in claim 19, further comprising a coupling between a cap and the increased pressure-producing device.

21. An applicator device as set forth in claim 20, further comprising a screwthread for holding the cap on the applicator device.

22. An applicator device as set forth in claim 20, further comprising a bayonet fixing for holding the cap on the applicator device.

23. An applicator device as set forth in claim 1, further comprising a storage means having a front end region for storage of a product to be applied, and a writing tip, wherein a rear end region of the writing tip is sleeve-shaped and the front end region of the storage means is inserted into the rear end region of the writing tip.

24. An applicator device as set forth in claim 1, wherein the transmission arrangement comprises a toothed rack and a latch, wherein the toothed rack and the latch are adapted to come into engagement with each other and out of engagement with each other in the two different operative states.

* * * * *